US010186336B2

(12) United States Patent
Liu et al.

(10) Patent No.: US 10,186,336 B2
(45) Date of Patent: Jan. 22, 2019

(54) PACKAGING DESIGN FOR STORAGE, TRANSPORTATION, AND DISPOSAL OF DISUSED RADIOLOGICAL SOURCES

(71) Applicants: Yung Y. Liu, Hinsdale, IL (US); Zenghu Han, Woodridge, IL (US); James M. Shuler, Germantown, MD (US)

(72) Inventors: Yung Y. Liu, Hinsdale, IL (US); Zenghu Han, Woodridge, IL (US); James M. Shuler, Germantown, MD (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 0 days.

(21) Appl. No.: 15/435,640

(22) Filed: Feb. 17, 2017

(65) Prior Publication Data

US 2018/0240560 A1 Aug. 23, 2018

(51) Int. Cl.

| | |
|---|---|
| ***G21F 5/14*** | (2006.01) |
| ***G21F 9/36*** | (2006.01) |
| ***G21F 5/012*** | (2006.01) |
| ***G21F 3/00*** | (2006.01) |

(52) U.S. Cl.

CPC ..... *G21F 5/14* (2013.01); *G21F 3/00* (2013.01); *G21F 5/012* (2013.01); *G21F 9/36* (2013.01); *G21Y 2002/305* (2013.01); *G21Y 2002/502* (2013.01); *G21Y 2002/60* (2013.01); *G21Y 2004/601* (2013.01)

(58) Field of Classification Search

CPC ... G21F 5/14; G21F 3/00; G21F 5/012; G21F 9/36

USPC ..... 588/16

See application file for complete search history.

(56) References Cited

U.S. PATENT DOCUMENTS

| | | | | |
|---|---|---|---|---|
| 8,616,404 | B1 | 12/2013 | Starck et al. | |
| 9,875,819 | B2 * | 1/2018 | Singh | G21F 5/012 |
| 2004/0011971 | A1 | 1/2004 | Nicholson et al. | |
| 2014/0039235 | A1 * | 2/2014 | Subiry | G21F 5/012 588/16 |
| 2016/0012926 | A1 | 1/2016 | Lehnert et al. | |

* cited by examiner

*Primary Examiner* — Edward M Johnson

(74) *Attorney, Agent, or Firm* — Cherskov Flaynik & Gurda, LLC

(57) ABSTRACT

A system for encapsulating and storing disused radiological sources in sealed capsules is provided, the system having a basket to removably position capsules relative to each other, the capsules containing the radiological sources; a containment vessel for receiving the basket; and a cask reversibly encapsulating or otherwise housing the containment vessel. Also provided is a method for packaging, transporting and storing disused radiological sources, the method having the steps of transporting sealed capsules containing radiological sources from water pools to baskets; placing the basket in a containment vessel and sealing the vessel with helium backfill; placing the vessel in a cask and reversibly capping the cask; surrounding the cask with personnel a shield and crumple zones to create a construct; and transporting and storing the construct until its final disposal at a geological repository or a deep borehole, all without repackaging of the disused radiological sealed capsules.

13 Claims, 6 Drawing Sheets

PACKAGING DESIGN FOR STORAGE, TRANSPORTATION, AND DISPOSAL OF DISUSED RADIOLOGICAL SOURCES

CONTRACTUAL ORIGIN OF THE INVENTION

The U.S. Government has rights in this invention pursuant to Contract No. DE-AC02-06CH11357 between the U.S. Department of Energy and UChicago Argonne, LLC, representing Argonne National Laboratory.

BACKGROUND OF THE INVENTION

1. Field of the Invention

This invention relates to disused radiological sources, and more specifically, this invention relates to a system and method for packaging disused radiological sources for dry storage, transportation and disposal.

2. Background of the Invention

There are several types of packaging for radioactive material, depending on the activity of radioactive content. Per Title 10 of the Code of Federal Regulations (CFR), Part 71 entitled "Packaging and Transportation of Radioactive Materials," a Type B packaging is required for transportation of radioactive material of Type B quantities. (Type B quantity means a quantity of radioactive material greater than a Type A quantity.)

Packaging means the assembly of components necessary to ensure compliance with the packaging requirements of 10 CFR Part 71. It may consist of one or more receptacles, absorbent materials, spacing structures, thermal insulation, radiation shielding, and devices for cooling or absorbing mechanical shocks. The vehicle, tie-down system, and auxiliary equipment may be designated as part of the packaging.

After discharging from reactors, commercial spent nuclear fuel (SNF) in the U.S. is typically stored in spent fuel pools at the reactor sites for over five years. Then it is moved into dry cask storage systems (DCSS) at a licensed Independent Spent Fuel Storage Installations (ISFSI) for up to 40 years. The license of ISFSI may be renewed for an additional term not to exceed another 40 years per 10 CFR 72.42. Typical DCSSs weigh over 100 tons.

Each dry storage canister/cask could contain multiple tens of SNF assemblies, wherein the canisters are placed in overpacks that are designed for long term storage but not transportation after storage or disposal. (An overpack, as defined by the International Air Transport Association's Dangerous Goods Regulations, is an enclosure used by a single shipper to contain one or more packages and to form one handling unit for convenience of handling and storage.)

There are many other forms of SNF and high level waste (HLW) at Department of Energy (DOE) sites and facilities, and disused radiological sources that need to be moved out of their current storage pools for extended dry storage, subsequent transportation, and final disposal at geological repositories. For example, sealed capsules of cesium and strontium isotopes heretofore were used to irradiate food for preservation and sterilize medical equipment. Approximately 1900 of these capsules exist.

Department of Energy (DOE) facilities are not designed for wet-to-dry storage of disused radiological sources using commercial SNF DCSSs.

DOE has planned to dispose all HLW and SNF, regardless of commercial, defense, or research origin, in a common mined geologic repository. Separate mined repositories for DOE SNF and HLW as well as deep borehole disposal options have been proposed, particularly for small waste forms such as Cs/Sr capsules. Currently, these capsules are stored in pool cells at Hanford's Waste Encapsulation and Storage Facility (WESF).

A need exists in the art for a system and method to enable one time packaging of disused radiological sources to facilitate transfer, storage and transportation and disposal. The system and method should not require unusual materials or material handling protocols. Also, the system and method should facilitate storage and disposal in current and proposed repository paradigms.

SUMMARY OF INVENTION

An object of the invention is to provide a system and method for packaging disused radiological sources that overcomes many of the drawbacks of the prior art.

Another object of the invention is to provide a compact Type B packaging design. A feature of the invention is that enables the transfer of Cs/Sr capsules out of pool cells and into extended dry storage sites for no less than a 50 year duration. The design further facilitates ultimate transfer from the dry storage site to mined geological repositories, or deep bore holes. The invented design is also applicable to other disused commercial radiological sealed capsules. The advantage of the invention is that it facilitates a one-time placement and direct handling of capsules into encapsulation casks (such as containment vessels), thereby obviating the need for re-handling or repackaging of the capsules after initial storage.

Another object of the present invention is to provide a system and method for facilitating loading, unloading and transfer of disused radiological sources in space-, thermal- and weight-restricted venues. A feature of the invention is its all metal structure with heat dissipation capability of up to 1000 W. An advantage of the invention is that it incorporates a personnel shield for radiation-, thermal-, and impact-protection. Another advantage is that it can be manipulated with a forklift.

Briefly, the invention provides a system for encapsulating and storing disused radiological sources, the system comprising a basket to removably position capsules relative to each other, the capsules containing the waste; a containment vessel for receiving and completely encapsulating the basket; and a cask reversibly housing the containment vessel.

Also provided is a method for packaging, transporting and storing radiological sources, the method comprising transporting disused radiological sources from water pools to baskets; placing the baskets in a containment vessel and sealing the vessel; placing the vessel in a cask and reversibly capping the cask; surrounding the cask with a personnel shield and crumple zones to create a construct; and transporting and storing the construct, during which time the disused radiological sources are not removed from the containment vessel.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

Figure 1:
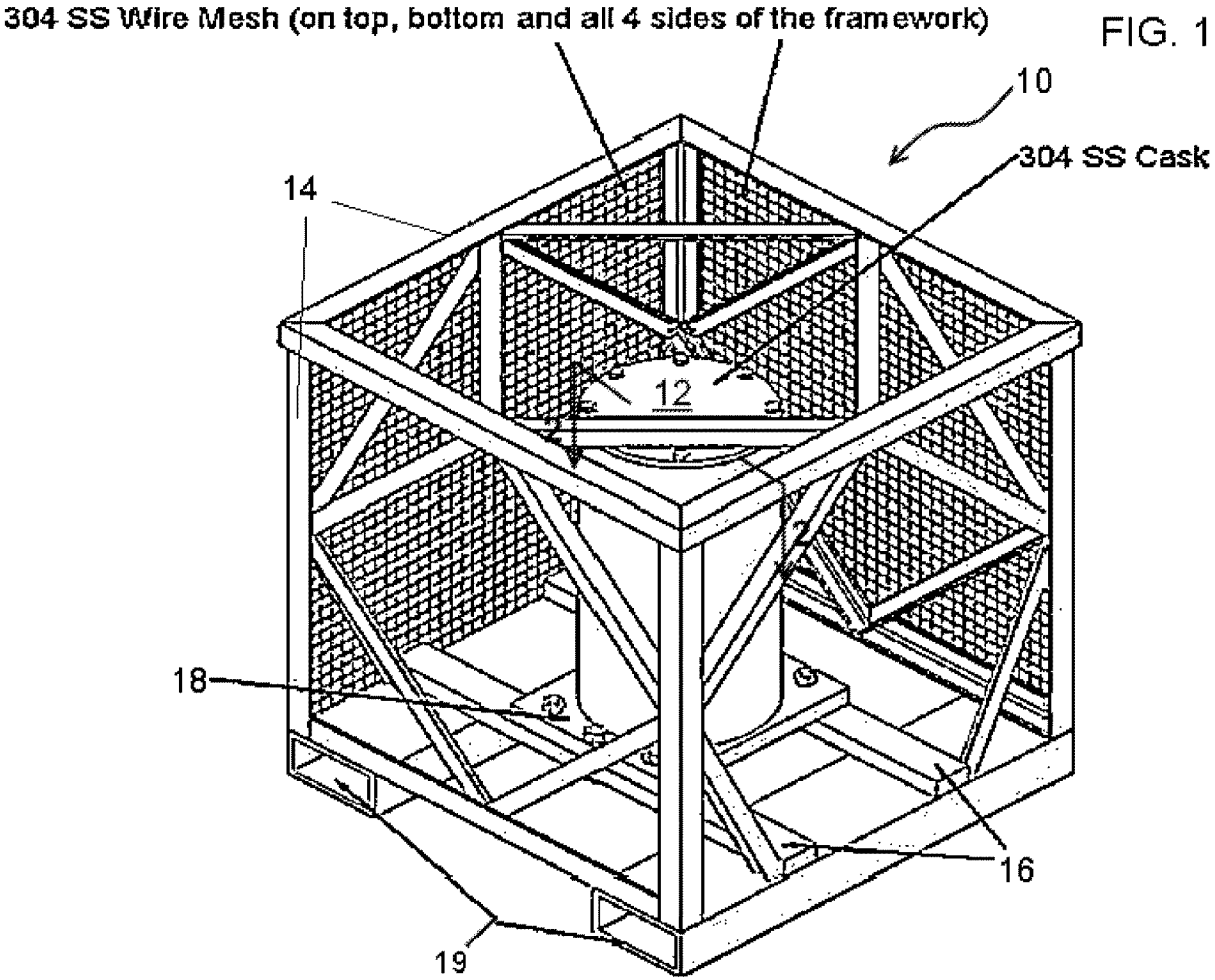
FIG. 1 is a perspective view of the invented system.

The foregoing summary, as well as the following detailed description of certain embodiments of the present invention, will be better understood when read in conjunction with the appended drawings.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

The following detailed description should be read with reference to the drawings in which similar elements in different drawings are numbered the same. The drawings, which are not necessarily to scale, depict illustrative embodiments and are not intended to limit the scope of the invention.

As used herein, an element or step recited in the singular and preceded with the word "a" or "an" should be understood as not excluding plural said elements or steps, unless such exclusion is explicitly stated. As used in this specification and the appended claims, the term "or" is generally employed in its sense including "and/or" unless the content clearly dictates otherwise.

Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

A compact Type B packaging design is proposed for transfer of disused radiological sources, e.g., Cs/Sr sealed capsules out of pool cells and into dry storage sites for extended storage. Durations of some instances of dry storage are no less than 50 years. The design further facilitates ultimate transfer from the dry storage site to mined geological repositories, or deep boreholes, without the need for re-handling or repackaging the capsules.

The invented design has an all metal structure that can accommodate various disused radiological sources with heat dissipation capability up to 1000 W. An embodiment of the packaging design incorporates a personnel shield with 304 stainless steel (SS) wire mesh on all sides for radiation shield and thermal protection. As such, the mesh may envelope a framework on top, bottom and all four sides of a cage surrounding a 304 SS cask that encloses a 304L SS containment vessel. Carbon steel (CS) structural tubes at the bottom of the packaging facilitate transfer with a forklift or other typical industrial type lifting apparatus.

An embodiment of the invented structure comprises basket made of depleted uranium (DU). This type of construction confers radiation shielding performance during normal operation, structural integrity during accident conditions, and general corrosion and stress corrosion during extended dry storage for at least 50 years. The invented design is suitable for transporting disused radiological sources after extended (more than 50 years) dry storage, without repackaging, directly to a geological repository or to a deep bore hole for final disposition.

FIG. 1 is a perspective view of an embodiment of the invention, designated as numeral 10. As an overview, the invention 10 comprises a cask 12 surrounded by a cage 14 which serves as a personnel shield. The cask 12 has an upwardly facing end 13 and a downwardly or depending end 15. The depending end 15 of the cask 12, typically made from corrosion resistant material (e.g. stainless steel) rests upon a plurality of elongated stainless steel structures 16 and is reversibly attached thereto.

Figure 2:
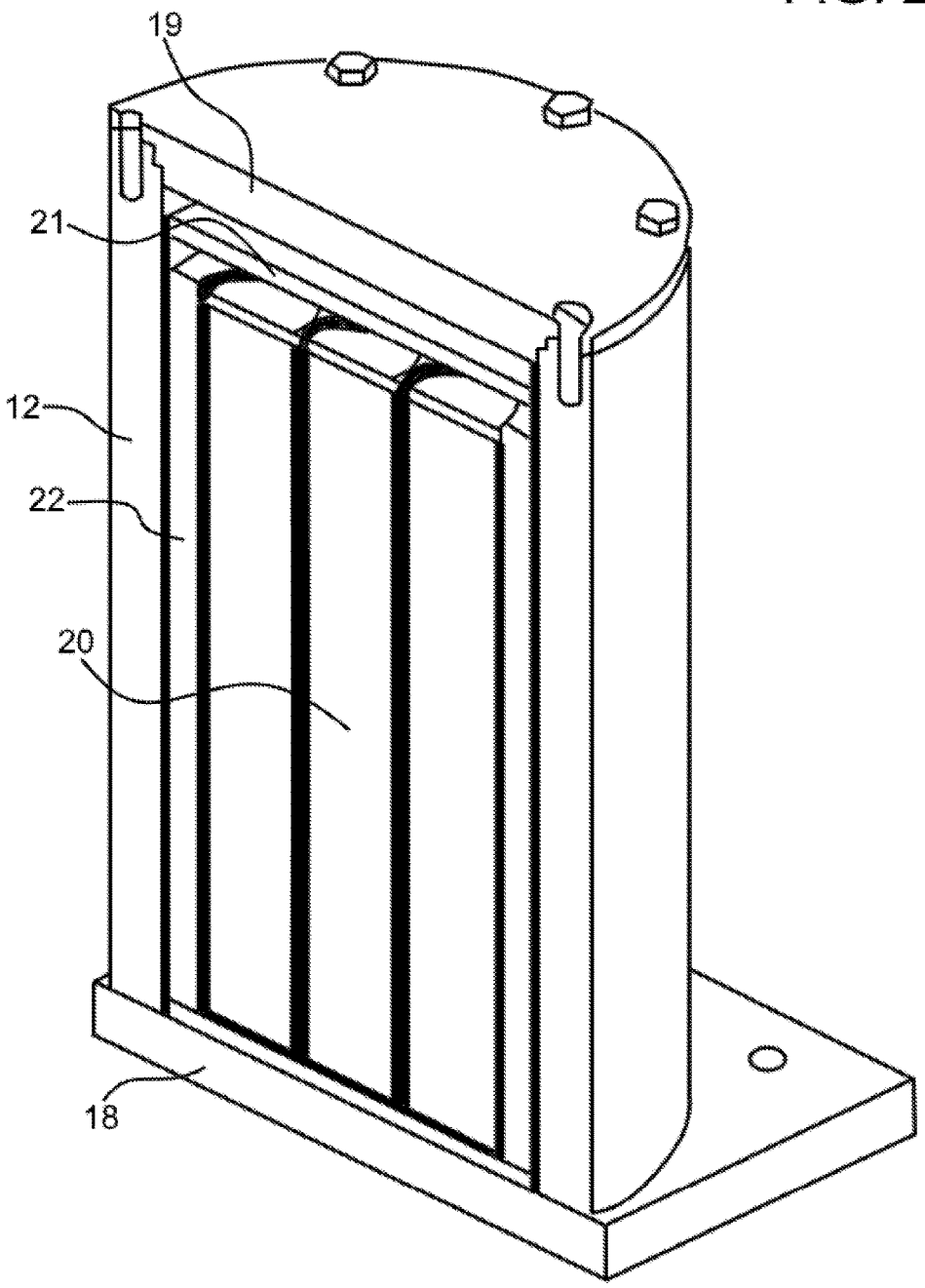
FIG. 2 is a cutaway view of the invented cask and contents, taken along line 2-2 of FIG. 1.

The upwardly facing end 13 of the cask terminates in a reversibly attachable lid or cap 19 (FIG. 2). The lid may be permanently welded, or else reversibly mated with the mouth of the cask in a threaded configuration or with nuts and bolts. Reversible attachment is often preferred so that the containment vessel can be removed and deposited in narrow bore holes or other spacially constrained repository configurations.

The cask geometry and structures enclosed therein as discussed infra, can vary. The cask is adapted to receive a cylindrical containment vessel 21 having a similar cross section, such that the cask and containment vessel nested therein are coaxial to each other. The containment vessel 21 permanently sequesters a plurality of elongated tubes or capsules 20 containing disused radiological sources. As such, the containment vessel is irreversibly sealed once it is filled with the radiological sources, but the containment vessel is not irreversibly sealed within its cask. This feature allows for the cask to be utilized as a transport pod in conjunction with its personnel protecting framework during transport and dry storage of the containment vessel within. The cask also confers protection to the containment vessel during transport and dry storage given that the cask completely encapsulates the containment vessel. The feature also allows for the containment vessel to be removed from its transport pod for final disposal into a deep borehole while all the while eliminating any fluid communication between the radiological sources on the one hand, and personnel, the atmosphere and any geologic structures such as aquifers, fault lines, etc., on the other hand.

A salient feature of an embodiment of the invention is that the cask, the containment vessel, and the capsules are all elongated in configuration, such that the longitudinal axes all of these structures are coaxial with each other. This confers space saving to a high volume and a slender design to allow a small diameter (i.e. between 6 and 24 inches, preferably between about 7 and 14 inches, and most preferably between about 8.5 and about 12.25 inches) bore hole to be utilized to finally dispose the containment vessel containing the radiological sources. Generally, the containment vessel/capsule construct defines no corners or sharp edges but rather a continuous convex surface. This will confer ease during bore hole insertion and placement.

Ideally, the cask 12, the support structures 16, and a cask baseplate 18 positioned between the cask and supports, comprise the same material so as to minimize galvanic action during any long term disposition prior to disposal. In an embodiment of the invention, the baseplate 18 is integrally molded or otherwise attached to the cask 12 for example by welding. In other embodiments, the baseplate is reversibly attached to the cask.

The aforementioned structures are surrounded by a framework wrapped in a wire mesh, together comprising the cage 14. No particular gauge mesh is required, as long as air flow through the structure is not impeded and access is limited. Mesh gauge may be chosen so as to prevent personnel from inserting their hands or fingers through the plane defined by the mesh surfaces.

The framework may be comprised of any corrosion resistant material (e.g., stainless steel) with structural members including horizontally disposed substrates attached at their ends by vertically disposed substrates. Angle braces may also be employed and attached at one end to the horizontal substrates and at the other end to the vertical substrates. Generally cubic shaped, the entire construct may define different sizes. For example, an embodiment of the construct may be 3 feet long, 3 feet wide, and 3 feet high). However, other geometric shapes are suitable, including those which may interlock with each other.

FIG. 2 is a view of FIG. 1 taken along line 2-2. The cask 12 is adapted to ultimately receive and store a plurality of capsules 20 (such as standard issue Cs/Sr capsules which have an outer diameter of about 2.6 inches, and about a 21 inch length), so as to define a generally elongated configuration. However, and as discussed infra, a plurality of protective layers (e.g., radiological and physical) exist between the external surfaces of the capsules and the inwardly facing surface of the cask. As such, the radiological material within the capsules remains in the capsules and is not required to be bagged, solidified or otherwise processed. The invention therefore provides long term disposal of a radiological source originally placed in the capsules several decades prior.

Figure 4:
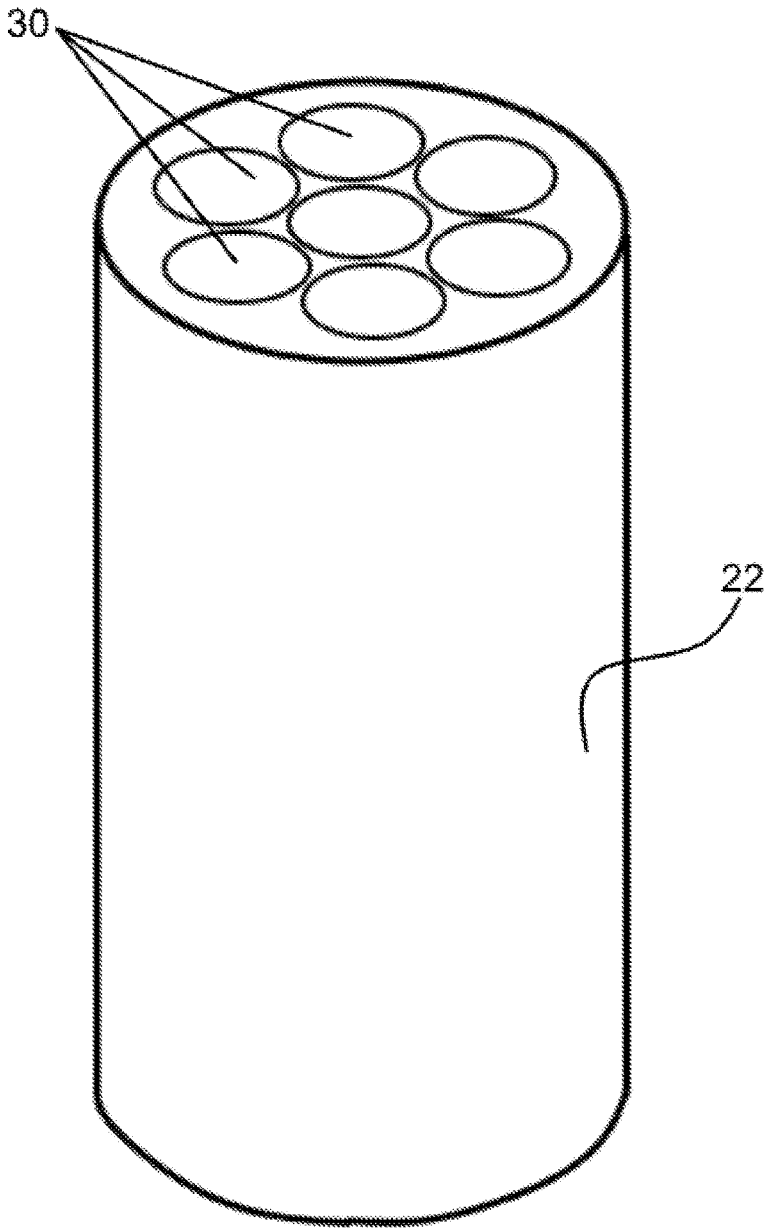
FIG. 4 is a perspective view of a capsule basket, in accordance with features of the present invention.

Prior to insertion into a cask 12, first the capsules are reversibly arranged relative to each other in a basket 22, wherein the basket defines a predetermined number of cavities each configured to slidably receive a capsule 20. FIG. 4 depicts a version of the basket 22 wherein the apertures formed in the basket each house one capsule and completely encircle the capsule (e.g., the sides and bottoms). As such, these nesting apertures prevent fluid and or chemical communication between capsules in the unlikely event one of the capsules leaks. In such a configuration, the basket reversibly positions the capsules relative to each other. The basket and the capsule receiving apertures formed therein, may comprise a single molded piece, or several pieces welded together.

Figure 3:
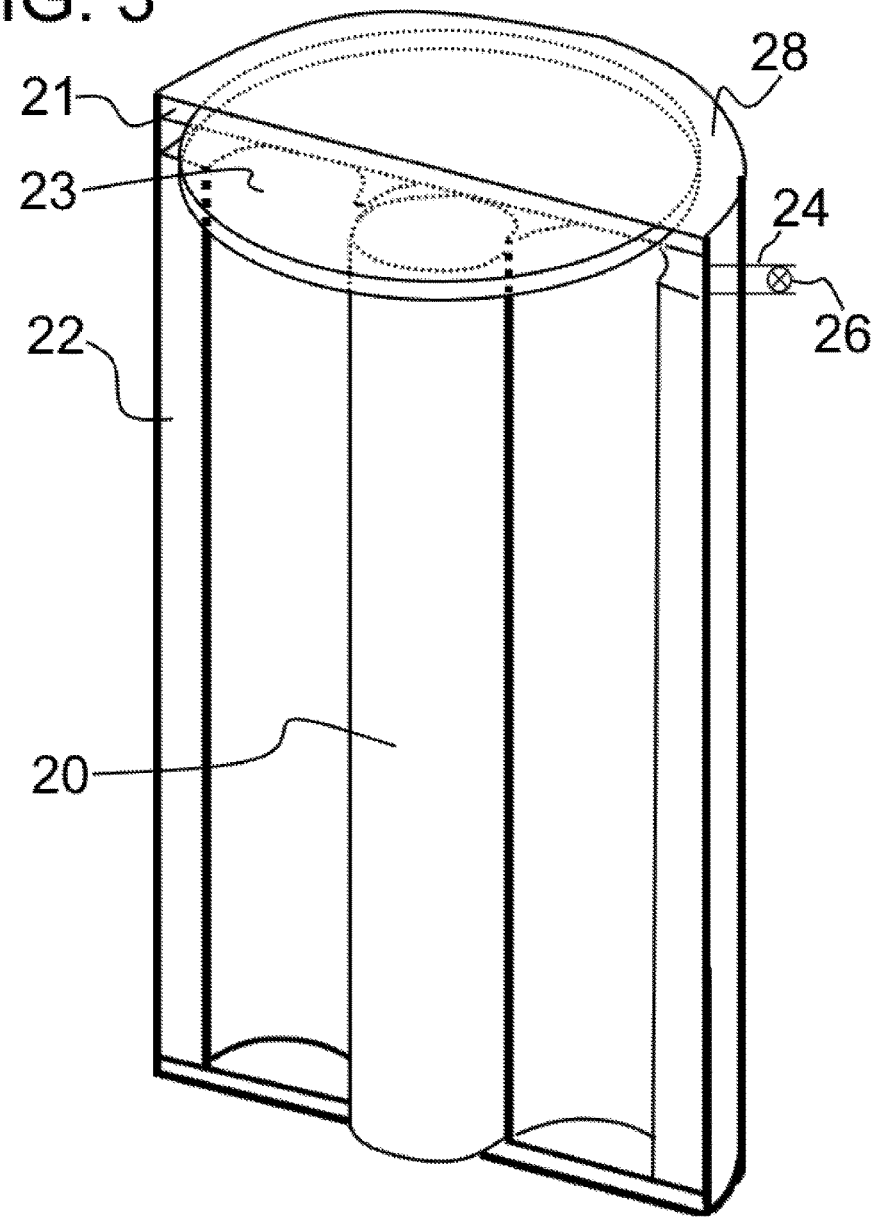
FIG. 3 is a cutaway view of a containment vessel and capsule basket, in accordance with features of the present invention.

The basket 22, once so loaded, is placed within a containment vessel (numeral 21 in FIGS. 2 and 3) so as to be coaxial with the containment vessel. A disc insert 23 is placed on top of the basket but below a lid or cap 28 (FIG. 3) of the containment vessel to provide shielding for radiation in the axial direction. This disc may be comprised of the same material as the basket, e.g., DU. Alternatively, the lid 28 and the disc may be the same structure. The disc 23 has approximately the same cross section diameter as the basket, the center of the disk 23 positioned coaxial with the basket and containment vessel.

Once the basket is loaded within the containment vessel 21, the vessel is sealed to permanently enclose the capsules therein. One method for sealing includes welding a lid or cap 28 of the vessel to the periphery of the capsule defining its upwardly facing opening. Given the necessity of a complete seal, any weld must meet or exceed the requirements of the ASME Boiler & Pressure Vessel Code, Section III, Division 3 "Containments for Transportation and Storage of Spent Nuclear Fuel and High Level Radioactive Material and Waste," or its equivalent, Section III, Division 1, Subsection NB.

In an embodiment of the containment vessel, a gas port 24 is provided to establish and maintain a non-ambient gas environment within the containment vessel. For example, the port is adapted to receive a pressurized gas line with which to first evacuate air from the sealed containment vessel 21 and then inject helium (or some other relatively inert gas such as argon or nitrogen) into the evacuated space. Helium is a particularly good conductor of heat such that it provides additional means to facilitate thermal conductance of heat from the capsule and to the walls of the containment vessel 21. A distal end of the port 24 may terminate in a valve 26 to facilitate evacuation and subsequent filling of the cask void with desired gas. Alternatively, after backfilling with desired fluid, the fluid ingress/egress port may be sealed, such as by welding. Precautions should be taken so as not to allow the helium to escape when the final port termination weld is complete. After welding the containment vessel should be checked for leaks according to ANSI N14.5-2014 Leakage Tests on Packages for Shipment of Radioactive Materials.

The containment vessel 21 is then slidably and coaxially received by the cask.

FIG. 4 is a perspective view of the basket used to position the capsules relative to each other. The capsule depicted in FIG. 4 shows 7 capsule tunnels 30, thereby accommodating the relative positioning of 7 capsules. More or fewer tunnels may be employed, depending on the radioactivity of the capsules, the diameter of the capsules and the diameter of the borehole. In an embodiment of the invention, the basket is designed to prevent capsules, so nested within, from contacting each other. In other embodiments, the capsules may be nested within so as to allow contact with each other. This second embodiment may be preferred to minimize weight of the basket and therefore the entire structure.

Figure 5:
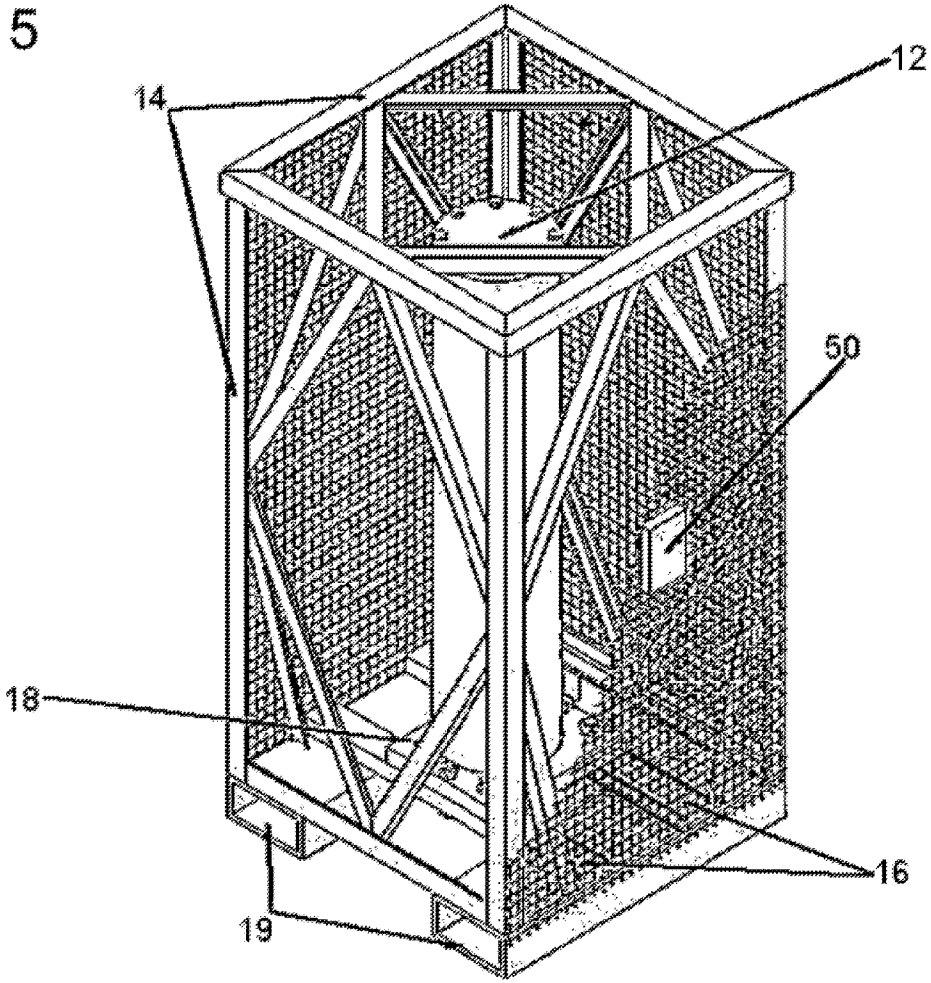
FIG. 5 is a perspective view of an elongated storage system, in accordance with features of the present invention.

For example, it must be appreciated that the cask 12, the basket 22 and the containment vessel 21 can be designed in longer lengths so as to accommodate the stacking of two capsules (e.g. one capsule on top of another) within the same tunnel in the basket. This slender and taller configuration, depicted in FIG. 5, will allow for disposal of Cs/Sr capsules in a containment vessel directly into a narrow deep borehole after the containment vessel is removed from the cask. In such instances, a spacer may be positioned in between the coaxially stacked capsules. This spacer would be of sufficient thickness, rigidity/stiffness and reversible deformation strength to simultaneously provide rigidity and cushioning between stacked capsules.

To accommodate the slender configuration, the capsule basket may be designed to receive fewer capsule stacks than the aforementioned embodiment, described supra. For example, given the standard size and diameter of Cs/Sr capsules, only three capsule tunnels may be provided to provide relative positioning for three capsule stacks in the immediately described elongated configuration. Given two capsules per stack, the capsule capacity of this slimmer configuration is still maintained at 6 which is similar to the same capsule capacity of the basket depicted in FIG. 4. In summary of this point, the containment vessel 21 dimensions in this slender embodiment would facilitate it being received by narrow bore holes (e.g., approximately 12.5 inches in diameter).

Figure 6:
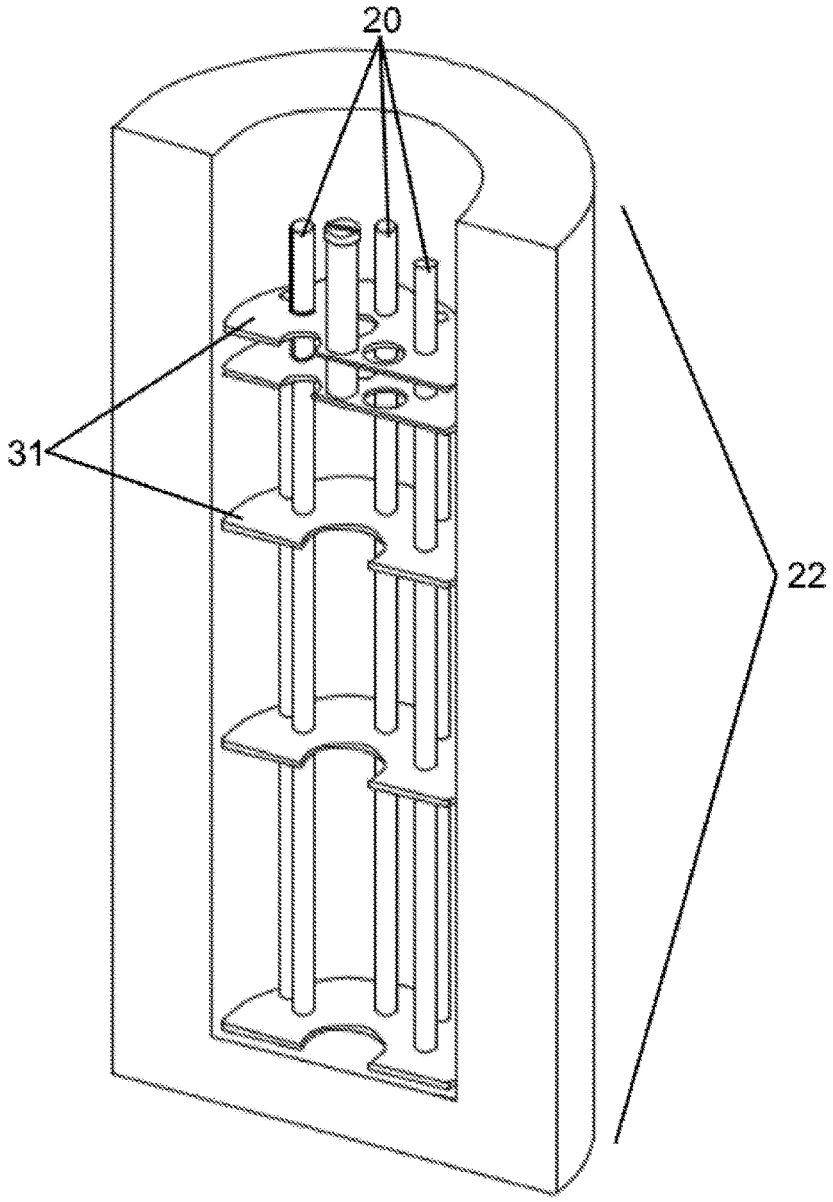
FIG. 6 is a perspective view of a capsule basket with grid spacers holding commercial radiological sources, in accordance with features of the present invention.

Capsule sizes may vary, depending on the disused radiological sources being sequestered. Cs/Sr capsules for example have an outer diameter of approximately 2.6 inches and a length of approximately 21 inches. Other, disused commercial sealed sources may be about 18 inches long and a half inch or less (for example about 0.4 inches) in outer diameter. As such, baskets may be designed to frictionally and/or slidably engage and hold the capsules in place of a certain size. Grid spacers 31, as depicted in FIG. 6, may facilitate this reversible frictional/slidable engagement. The spacers 31 are generally disk-shaped and arranged coaxial with each other and also with the basket. As such, the planes defined by each of the spacers are parallel with each other, with apertures formed in each of the spacers 31 adapted to slidably receive the capsules 20. Apertures of one spacer 31 lie in registration with apertures of another spacer so as to confer multiple sites of frictional engagement for the same capsule nested within the respective apertures. It should be appreciated that the apertures of the spacers have a diameter to interact with the outer diameter of the capsule so as to confer frictional engagement. This will allow the spacers to remain at a position along longitudinally extending surfaces of the capsules once placed and minimize any unintended movement of the spacers due to gravity or transport or forklift operations.

Alternatively, the spacers may be held in place by weldments to tie rods comprising structure of the basket.

The baskets may be designed to simultaneously accommodate capsules of different sizes.

The entire construct may comprise different materials for different components. For example, suitable material comprising the framework for the cage and the mesh comprises metal which provides protection against general corrosion. Suitable material may include 304 SS, which may also be used for the cask, the baseplate and the bars.

Also, constructing the cage with stainless steel confers structural integrity to the personnel shield, cooling by air, and impact resistance to the cask construct. This is particularly relevant if the construct is housed in a large repository enclosure (e.g., Yucca Mountain) where fork lift traffic and the potential for jostling is high compared to deep borehole deposition.

The material for the basket may include 304 SS or depleted uranium (DU) given that metal's superior shielding property for gamma radiation. The material for the containment vessel may include 304L SS and 316/316L SS. Together, these materials (e.g., 304/304L SS, 316/316L SS, depleted uranium (DU), and carbon steel (CS)) provide the following features:

a. radiation shielding performance during normal operation;
b. structural performance during hypothetical accident conditions prescribed in the U.S. federal regulations and international transport safety standards; and
c. general corrosion and stress corrosion cracking performance during extended dry storage of at least 50 years.

The invented packaging system meets the standards conferred in 10 CFR 71 for normal conditions of transport and hypothetical accident conditions.

When not in use, the sealed capsules are stored in water pools. At the end of life, the disused radiological sealed capsules are subjected to dry storage. This comprises the capsules being transferred to the baskets 22, which are subsequently encased and hermetically sealed in the containment vessels 21. Then, the containment vessels are loaded and encapsulated in casks, 12, the casks being reversibly sealed. The casks may be free standing, or else already attached to the personnel shield 14 when receiving the containment vessels. Furthermore, unsealed containment vessels 21 may be already loaded within the uncapped casks when receiving the baskets 22.

Upon loading and capping of the casks, the casks (if not already) are placed within the personnel shield framework 14. To facilitate placement of the cask within the framework, a depending end of the cask may feature the aforementioned baseplate 18. This baseplate 18 may be reversibly attached to transversely extending support bars 16 proximal to the floor of the structure 10.

A means (19, FIG. 1) for lifting and transporting the system is provided. One such means is a plurality of structural tubes adapted to receive forks of a fork lift. In the embodiment shown in FIG. 1, the tubes 19 are attached (either reversibly or irreversibly via welds) to a depending end of the frame work 14.

Such dry storage is protracted, often lasting 50 years or longer. In such a posture, the system 10 and its framework confer both personnel protection for forklift operators and crush zones in case the system is tipped or otherwise damaged.

Upon completion of dry storage, the capsule-basket-containment vessel construct is transported to its final resting place, either for direct disposal at a geological repository, or a deep borehole where the cask is first uncapped, and the containment vessel, still loaded with the baskets is removed therefrom to be inserted into the borehole. For example, a deep borehole that DOE contemplates to drill is approximately 5 km deep down to the basement rock. The bottom 2 km can be used to dispose about 2000 Cs/Sr capsules already loaded in approximately 280 welded containment vessels (assuming 7 capsules per CV). The top 3 km borehole is then filled/plugged thus isolating the disused radiological source in welded CV from ever reaching the surface.

A myriad of means for removing the containment vessel from the cask is suitable. For example, the lid of the containment vessel may form a threaded aperture adapted to receive an eyebolt. The aperture hole would be restricted to approximately 50 percent of the thickness of the lid. The lid may be reinforced on its inside facing surface. Alternatively, the entire cask may be tilted or even up ended to allow the containment vessel to slide out of the cask.

Modular sensors and modular communication platforms may be incorporated within the system. Such sensors include radiation, temperature, shock, and seal integrity, along with extended duration (10-year) batteries that power the sensors. Relevant communication platforms include wired, wireless cellular, and satellite portals. The ultimate selection of sensors and communication platforms would depend on the security posture in a storage facility, or in transportation vehicles based on a graded approach to security. Suitable sensors and integrated sensor packages are now known, for example such as those disclosed in U.S. Pat. Nos. 8.013,744, 9.520,057 and 9,514,431, the entirety of which is incorporated herein by reference.

Attachment of an integrated sensor device 50 (FIG. 5) onto the package is straightforward, and secured web application user interfaces have been developed for facility storage and for multi-vehicle transportation. Both have automatic alarm capabilities with adjustable sensor thresholds—low or high—depending on the perceived threat environment. Communications are two-way via a command and control center, which is linked to other emergency response and management entities. The integrated sensor 50 is seen removably attached to webbing comprising the mesh 14 of the system 10. However, the sensor may also be attached to the cask, or interior regions of the cask, such as on the containment vessel, with similar effect.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope.

While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. A system for encapsulating and storing radiological sources, the system comprising:

a) a basket to removably position capsules relative to each other, the capsules containing the radiological sources;

b) a containment vessel for reversibly receiving the basket; and c) a cask housing the containment vessel wherein the cask is surrounded in a framework of metal mesh.

2. The system as recited in claim 1 wherein the basket and the containment vessel are coaxially arranged.

3. The system as recited in claim 1 further comprising a means for transporting the framework.

4. The system as recited in claim 1 wherein the cask is removably received by the framework.

5. The system as recited in claim 1 wherein the basket symmetrically positions the capsules relative to each other.

6. The system as recited in claim 1 wherein the capsules are stacked on top of each other within the basket.

7. The system as recited in claim 1 wherein all of the components contain metal and the system has a 1000 W heat dissipation feature.

8. The system as recited in claim 1 wherein the basket comprises depleted uranium.

9. The system as recited in claim 1 wherein the framework comprises stainless steel webbing extending between horizontally and vertically disposed substrates.

10. The system as recited in claim 1 wherein the cask is removably received by the framework.

11. The system as recited in claim 1 further comprising a plurality of sensors attached to one of said cask, framework, or containment vessel.

12. The system as recited in claim 1 wherein the mesh defines a plane which enables airflow about the cask while simultaneously preventing personnel from inserting their hands through the plane.

13. The system as recited in claim 1 wherein the mesh provides crumple zones.

* * * * *